US010641067B2

(12) United States Patent
Xu et al.

(10) Patent No.: US 10,641,067 B2
(45) Date of Patent: May 5, 2020

(54) MECHANICAL AND HYDRAULIC DUAL-EFFECT EXPANSION DEVICE FOR WELL DRILLING WITH EXPANDABLE TUBULAR TECHNOLOGY

(71) Applicants: China National Petroleum Corporation, Beijing (CN); CNPC Engineering Technology R&D Company Limited, Beijing (CN)

(72) Inventors: Binggui Xu, Beijing (CN); Hongwei Yin, Beijing (CN); Huijuan Guo, Beijing (CN); Zhitong Liu, Beijing (CN); Mingjie Lv, Beijing (CN); Jianli Wang, Beijing (CN); Qiang Li, Beijing (CN); Peng Kang, Beijing (CN); Tao Jia, Beijing (CN); Xue Wang, Beijing (CN); Yi Tian, Beijing (CN); Aiguo Wang, Beijing (CN)

(73) Assignees: China National Petroleum Corporation, Beijing (CN); CNPC Engineering Technology R&D Company Limited, Beijing (CN)

( * ) Notice: Subject to any disclaimer, the term of this patent is extended or adjusted under 35 U.S.C. 154(b) by 204 days.

(21) Appl. No.: 15/744,129

(22) PCT Filed: Dec. 13, 2016

(86) PCT No.: PCT/CN2016/109620

§ 371 (c)(1),
(2) Date: Jan. 12, 2018

(87) PCT Pub. No.: WO2017/114149

PCT Pub. Date: Jul. 6, 2017

(65) Prior Publication Data

US 2018/0202267 A1 Jul. 19, 2018

(30) Foreign Application Priority Data

Dec. 30, 2015 (CN) ..... 2015 1 1021042

(51) Int. Cl.
*E21B 43/10* (2006.01)
*E21B 23/01* (2006.01)
(Continued)

(52) U.S. Cl.
CPC ..... *E21B 43/105* (2013.01); *E21B 23/01* (2013.01); *E21B 29/10* (2013.01); *E21B 34/063* (2013.01); *E21B 2034/007* (2013.01)

(58) Field of Classification Search
CPC ..... E21B 43/105; E21B 23/01
See application file for complete search history.

(56) References Cited

U.S. PATENT DOCUMENTS 6,681,860 B1 * 1/2004 Yokley ..... E21B 23/01 166/208
2004/0069499 A1 * 4/2004 Cook ..... E21B 17/08 166/380

(Continued)

FOREIGN PATENT DOCUMENTS

CN 101392633 A 3/2009
CN 101906947 A 12/2010

(Continued)

OTHER PUBLICATIONS

First Office Action dated Apr. 12, 2017 for counterpart Chinese patent application No. 201511021042.4 (China).

(Continued)

*Primary Examiner* — Blake E Michener
(74) *Attorney, Agent, or Firm* — Michael Best & Friedrich LLP

(57) ABSTRACT

A mechanical and hydraulic dual-effect expansion device for well drilling with expandable tubular technology includes an (Continued)

anchor having a lower end connected to an upper end of an insertion connection tube via a coupling, a hydraulic cylinder assembly comprising a hydraulic cylinder and a piston tube movably disposed within an inner cavity of the hydraulic cylinder, and a variable-diameter expansion cone assembly comprising a sealing cone portion and a variable-diameter expansion cone portion, wherein the sealing cone portion has an upper end connected to a lower end of the piston tube and a lower end connected to an upper end of the variable-diameter expansion cone portion. The mechanical and hydraulic dual-effect expansion device can facilitate completion of construction operations of an expandable tubular in a casing and an openhole system.

10 Claims, 5 Drawing Sheets

(51) Int. Cl.

| | |
|---|---|
| ***E21B 34/06*** | (2006.01) |
| ***E21B 29/10*** | (2006.01) |
| *E21B 34/00* | (2006.01) |

(56) References Cited

U.S. PATENT DOCUMENTS

| | | | | |
|---|---|---|---|---|
| 2005/0056433 | A1* | 3/2005 | Ring | E21B 43/105 166/384 |
| 2005/0194127 | A1 | 9/2005 | Campo | |
| 2008/0156499 | A1* | 7/2008 | Giroux | E21B 7/20 166/380 |
| 2008/0223571 | A1 | 9/2008 | Murray | |
| 2015/0247388 | A1* | 9/2015 | Di Crescenzo | E21B 23/01 166/382 |

FOREIGN PATENT DOCUMENTS

| | | | |
|---|---|---|---|
| CN | 101915059 | A | 12/2010 |
| CN | 101957293 | A | 1/2011 |
| CN | 102305053 | A | 1/2012 |
| CN | 202970565 | U | 6/2013 |
| CN | 203175447 | U | 9/2013 |
| CN | 105484695 | A | 4/2016 |
| CN | 205382907 | U | 7/2016 |

OTHER PUBLICATIONS

Search Report dated Apr. 12, 2017 for counterpart Chinese patent application No. 201511021042.4 (China).
Second Office Action dated Nov. 17, 2017 for counterpart Chinese patent application No. 201511021042.4 (China).
International Search Report for PCT application No. PCT/CN2016/109620 dated Mar. 9, 2017.

* cited by examiner

MECHANICAL AND HYDRAULIC DUAL-EFFECT EXPANSION DEVICE FOR WELL DRILLING WITH EXPANDABLE TUBULAR TECHNOLOGY

CROSS REFERENCE TO RELATED APPLICATIONS

This application is a U.S. national phase application of PCT/CN2016/109620, filed Dec. 13, 2016, which claims priority to CN 201511021042.4, filed Dec. 30, 2015, the entire contents of both of which are herein incorporated by reference.

TECHNICAL FIELD

The present invention pertains to the field of drilling and completion technology in the oil and gas industry, and in particular to, an openhole expandable casing tool applicable to an openhole system, and more particularly to, a mechanical and hydraulic dual-effect expansion device for well drilling with expandable tubular technology.

BACKGROUND OF THE INVENTION

Expandable Tubular Technology is a new technology which emerged and was developed in the 1990s, and is applicable to operation processes, such as drilling, completion, oil production, workover and the like, and is touted as a new technology that can bring about a transformative development. The so-called expandable tubular is a metallic circular tubular made of special materials, its original state has a good extensibility, and its inner and outer diameters are expanded and are subjected to permanent plastic deformation with an expansion rate of from 15% to 30% by the pressing action of the expansion cone under the action of the expansion force. The expandable tubular technology changes a crystal structure and mechanical properties of the expandable tubular material by implementing tubular expanding operations of the expandable tubular so that its strength index is improved, while its plasticity index is decreased. The expandable tubular technology can allow an expandable tubular to obtain mechanical performance indices equivalent to those of a specific steel casing by technical means of selecting the expandable tubular material, controlling the expansion rate, and the like, so as to meet operational requirements of petroleum engineering.

The expandable tubular technology can be generally used to solve the problems caused by complex formations, e.g., blocking a serious thirsty formation to solve the problem of wellbore collapse; and the technology can also be used for casing patch and repair. According to the use of the expandable tubular technology, it can be classified into plural major technical systems, such as a casing patch system, an openhole system, an expandable tail tubular suspension system, a diameter-equivalent drilling and completion system, and the like.

The openhole system of the expandable tubular refers to a technology of adding a section (or a plurality of sections) of expandable tubular for isolation of a defective layer section between casing series initially commonly used in the openhole section, when drilling the defective openhole section in the drilling process. Under normal circumstances, the well crews can take technical measures of running casing in advance to solve the drilling problem, its result would lead to a series of associated technical problems, and even affect drilling of the final destination layer due to disruption of the casing sequence specified in the original drilling design. The openhole system technology of the expandable tubular utilizes addition of expandable tubular between the casing series initially commonly used, so that a drift diameter of the borehole has almost no loss after the construction operations are completed, which thus not only achieves the objective of dealing with down-hole troublesome conditions, but also can ensure a normal proceeding of the follow-up drilling construction. However, the existing domestic expandable tubular technology has an expansion rate of the expandable tubular of only 10% or so, a serious loss arises in the drift diameter of the borehole, and the original drilling head cannot continue to drill through after constructions with the expandable tubular, thereby affecting follow-up drilling operations.

Accordingly, the present inventors have developed a mechanical and hydraulic dual-effect expansion device for well drilling with expandable tubular technology with almost no loss of a drift diameter of a borehole according to years of experience in design and production engaged in this field and the related fields, so as to solve the existing technical problems.

SUMMARY OF THE INVENTION

It is an objective of the present invention to provide a mechanical and hydraulic dual-effect expansion device for well drilling with expandable tubular technology, which can complete construction operations of expandable tubular in a casing and an openhole system and ensure a follow-up drilling procedure proceeds normally.

Accordingly, the present invention provides a mechanical and hydraulic dual-effect expansion device for well drilling with expandable tubular technology, comprising:

an anchor that can be anchored in downhole when a liquid is injected and pressurized, the anchor having a lower end connected to an upper end of an insertion connection tube via a coupling;

a hydraulic cylinder assembly comprising a hydraulic cylinder, and a piston tube movably disposed within an inner cavity of the hydraulic cylinder, wherein the hydraulic cylinder has an upper end connected to the insertion connection tube via a cylinder adjustment cover and a lower end tightly fitted with the piston tube, wherein the piston tube passes through an inner cavity of the cylinder adjustment cover, and has an upper end inserted in the insertion connection tube and tightly fitted with an inner surface of the insertion connection tube, wherein the piston tube is provided on an outer side wall thereof with a protrusion ring which comes in contact with an inner surface of the hydraulic cylinder and separates the inner cavity of the hydraulic cylinder into an upper chamber and a lower chamber, and wherein the piston tube is also provided on a side wall thereof with a liquid injection hole in communication with the lower chamber; and a variable-diameter expansion cone assembly comprising a sealing cone portion capable of expanding the expandable tubular when moving upwards and a variable-diameter expansion cone portion capable of expanding a diameter when the liquid is injected and pressurized, wherein the sealing cone portion has an upper end connected to a lower end of the piston tube and a lower end connected to an upper end of the variable-diameter expansion cone portion.

According to a preferred example of the mechanical and hydraulic dual-effect expansion device as mentioned above, a lower end of the insertion connection tube is connected with an upper end of the cylinder adjustment cover through an external thread, and a lower end of the cylinder adjustment cover is threadably connected with an upper end of the hydraulic cylinder through an internal thread, and an inner surface of the lower end of the cylinder adjustment cover is tightly fitted with the piston tube.

According to a preferred example of the mechanical and hydraulic dual-effect expansion device as mentioned above, the upper end of the cylinder adjustment cover is provided with a cylinder dustproof ring sleeved onto the insertion connection tube, an outer surface at the upper end of the piston tube is embedded with a piston dustproof ring, an inner surface at the lower end of the cylinder adjustment cover is provided with a seal ring groove, inside which a seal ring that can be tightly fitted with the outer surface of the piston tube is embedded.

According to a preferred example of the mechanical and hydraulic dual-effect expansion device as mentioned above, the variable-diameter expansion cone portion comprises a central tube and a variable-diameter expansion cone capable of expanding a diameter when the liquid is injected and pressurized, an upper end of the central tube is connected to a lower end of the sealing cone portion, the variable-diameter expansion cone is sleeved on the central tube and is provided at both ends thereof with an upper end stop nut and a lower end stop nut, respectively, and the upper end stop nut and the lower stop nut are threadably connected with the central tube.

According to a preferred example of the mechanical and hydraulic dual-effect expansion device as mentioned above, the variable-diameter expansion cone comprises an upper expansion base, a plurality of upper expansion cone flaps, a plurality of lower expansion cone flaps, and a lower expansion base, the upper expansion base and the lower expansion base are sleeved onto the central tube, a clamp spring is embedded outside the upper expansion base, each of the upper expansion cone flaps and each of the lower expansion cone flaps are arranged alternately in the circumferential direction so as to slide in relation to each other, thereby combining as an expansion cone, an upper end of the upper expansion cone flaps is movably connected with the upper expansion base, and a lower end of the lower expansion cone flaps is movably connected with the lower expansion base.

According to a preferred example of the mechanical and hydraulic dual-effect expansion device as mentioned above, an upper end of the upper expansion base is abutted against the upper end stop nut, a cavity is formed between the upper expansion base and the central tube, an inner surface at the upper end of the upper expansion base is provided with a ring retainer coming in contact with the central tube, the cavity is provided with a return spring and a stopper, an upper end of the return spring comes in contact with the ring retainer and the lower end thereof comes in contact with the stopper, and the stopper is fixed with respect to the central tube.

According to a preferred example of the mechanical and hydraulic dual-effect expansion device as mentioned above, the sealing cone portion comprises a sealing tube, a sealing cone, a leather cup opening downwards, and a fixed retaining ring, the sealing cone, the leather cup, and the fixed retaining ring are sequentially sleeved onto the sealing tube, the fixed retaining ring is threadably connected with the sealing tube, a lower end of the sealing tube is connected to an upper end of the variable-diameter expansion cone portion, the outer surface of the sealing tube is provided with a ledge, the sealing cone is adjacent to an upper side of the ledge, and the cup is adjacent to a lower side of the ledge.

According to a preferred example of the mechanical and hydraulic dual-effect expansion device as mentioned above, a sliding sleeve is placed in the anchor for blocking a liquid incoming hole corresponding to the anchor, and is connected with the anchor via a shear pin; when moving downwards, the sliding sleeve is capable of entering the insertion connection tube and is supported at the upper end of the piston tube, the sliding sleeve having an outer diameter smaller than an inner diameter of the coupling and the insertion connection tube, and the side wall of the sliding sleeve being provided with a flowbore.

According to a preferred example of the mechanical and hydraulic dual-effect expansion device as mentioned above, the lower end of the expandable tubular is connected with a profiled pipe capable of expanding a diameter when the liquid is injected and pressurized, and a free end of the profiled pipe is connected with a lower plug.

According to a preferred example of the mechanical and hydraulic dual-effect expansion device as mentioned above, the profiled pipe has front, middle, and rear sections, a pipe diameter of the front and rear sections being larger than that of the middle section, and a smooth transition connection existing between the front and middle sections and between the middle and rear sections.

The mechanical and hydraulic dual-effect expansion device for well drilling with expandable tubular technology provided in the present invention is safe and reliable, and can complete construction operations of an expandable tubular in a casing and an openhole system and can accomplish expansion operations in an expansion ratio of 20% or higher; after the construction operations are completed, the present invention can not only achieve the objective of dealing with down-hole troublesome conditions, but also result in almost no loss of a drift diameter of a borehole after the construction, which is convenient for the follow-up drilling procedure.

BRIEF DESCRIPTION OF THE DRAWINGS

The following drawings are only intended to schematically describe and explain the present invention, but are not intended to limit the scope of the invention.

REFERENCE NUMERALS OF MAJOR ELEMENTS

Figure 1:
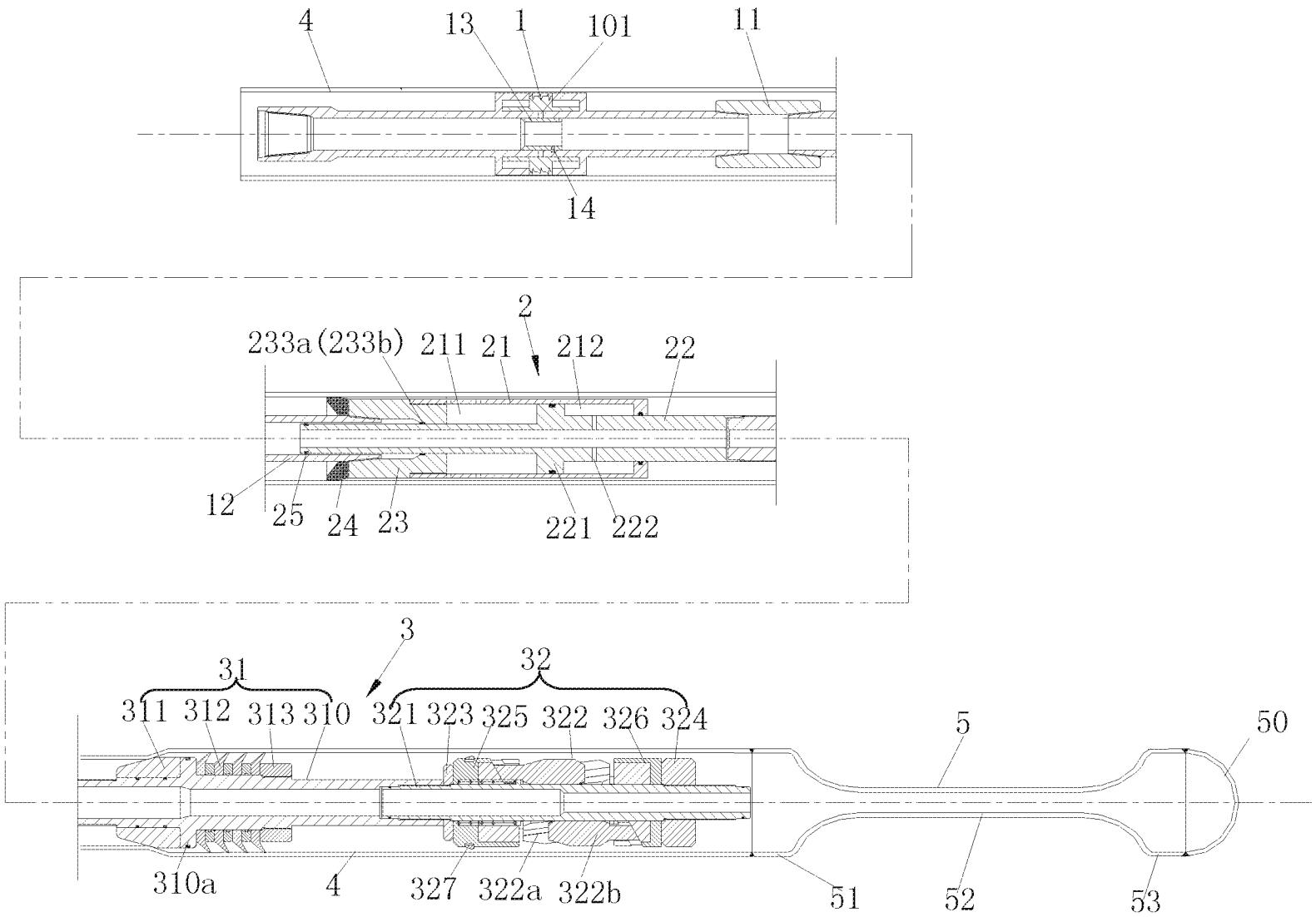
FIG. 1 is a schematic diagram illustrating compositions of a mechanical and hydraulic dual-effect expansion device for well drilling with expandable tubular technology according to the present invention.

| | | | |
|---|---|---|---|
| 1 | anchor | 11 | coupling |
| 12 | insertion connection tube | 13 | sliding sleeve |
| 14 | shear pins | | |
| 2 | hydraulic cylinder assembly | 21 | hydraulic cylinder |
| 211 | upper chamber | 212 | lower chamber |
| 22 | piston tube | 221 | protrusion ring |
| 222 | liquid injection hole | 23 | cylinder adjustment cover |
| 233a | seal ring groove | 233b | seal ring |
| 24 | cylinder dustproof ring | 25 | piston dustproof ring |
| 3 | variable-diameter cone assembly | 31 | sealing cone portion |
| 310 | sealing tube | 310a | ledge |
| 311 | sealing cone | 312 | leather cup |
| 313 | fixed retaining ring | 32 | variable-diameter expansion cone portion |
| 321 | central tube | 322 | variable-diameter expansion cone |
| 322a | upper expansion cone flaps | 322b | lower expansion cone flaps |
| 323 | upper end stop nut | 324 | lower end stop nut |
| 325 | upper expansion base | 3251 | ring retainer |
| 326 | lower expansion base | 327 | clamp spring |
| 328 | return spring | 329 | stopper |
| 4 | expandable tubular | 5 | profiled pipe |
| 50 | lower plug | 51 | front section |
| 52 | middle section | 53 | rear section |
| H | cavity | | |

DETAILED DESCRIPTION OF THE INVENTION

The present invention provides a mechanical and hydraulic dual-effect expansion device for well drilling with expandable tubular technology, comprising: an anchor that can be anchored in downhole when a liquid is injected and pressurized, having a lower end connected to an upper end of an insertion connection tube via a coupling; a hydraulic cylinder assembly comprising a hydraulic cylinder, and a piston tube movably disposed and passing through an inner cavity of the hydraulic cylinder, wherein the hydraulic cylinder has an upper end connected to the insertion connection tube via a cylinder adjustment cover, and a lower end tightly fitted with the piston tube, the piston tube passes through an inner cavity of the cylinder adjustment cover, and has an upper end inserted in the insertion connection tube and tightly fitted with an inner surface of the insertion connection tube, the piston tube is provided with a protrusion ring coming in contact with an inner surface of the hydraulic cylinder on an outer side wall, the protrusion ring separates the inner cavity of the hydraulic cylinder into an upper chamber and a lower chamber, and a liquid injection hole in communication with the lower chamber is also provided on a side wall of the piston tube; and a variable-diameter expansion cone assembly comprising a sealing cone portion capable of expanding the expandable tubular when moving upwards and a variable-diameter expansion cone portion capable of expanding a diameter when the liquid is injected and pressurized, the sealing cone portion has an upper end connected to a lower end of the piston tube and a lower end connected to an upper end of the variable-diameter expansion cone portion.

The mechanical and hydraulic dual-effect expansion device for well drilling with expandable tubular technology in the present invention can complete construction operations of an expandable tubular in a casing and an openhole system and can ensure a minimum loss of a drift diameter of a borehole.

The technical features, objects and effects of the present invention will become more apparent from the preferable examples taken in conjunction with the accompanying drawings, and the embodiments, structures, features and functions of the mechanical and hydraulic dual-effect expansion device for well drilling with expandable tubular technology provided in the present invention will be described in details later. In addition, the present invention is more fully understood when the technical means and functions are employed in order to achieve the predetermined objective by illustrating the embodiments, however, the accompanying drawings are provided for reference and illustration only and are not intended to be limiting of the invention.

Figure 2:
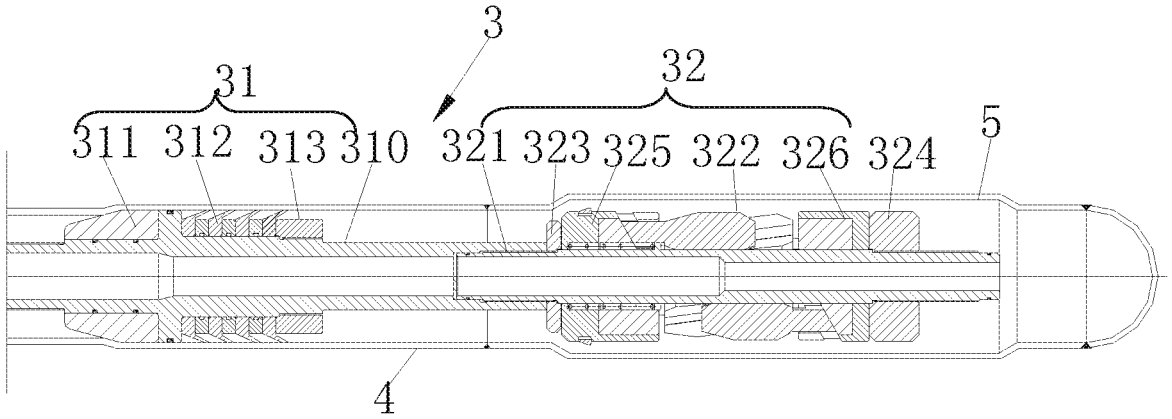
FIG. 2 is a partial schematic diagram illustrating the present invention when operating in downhole, at a state in which a liquid is initially injected and pressurized.
Figure 3:
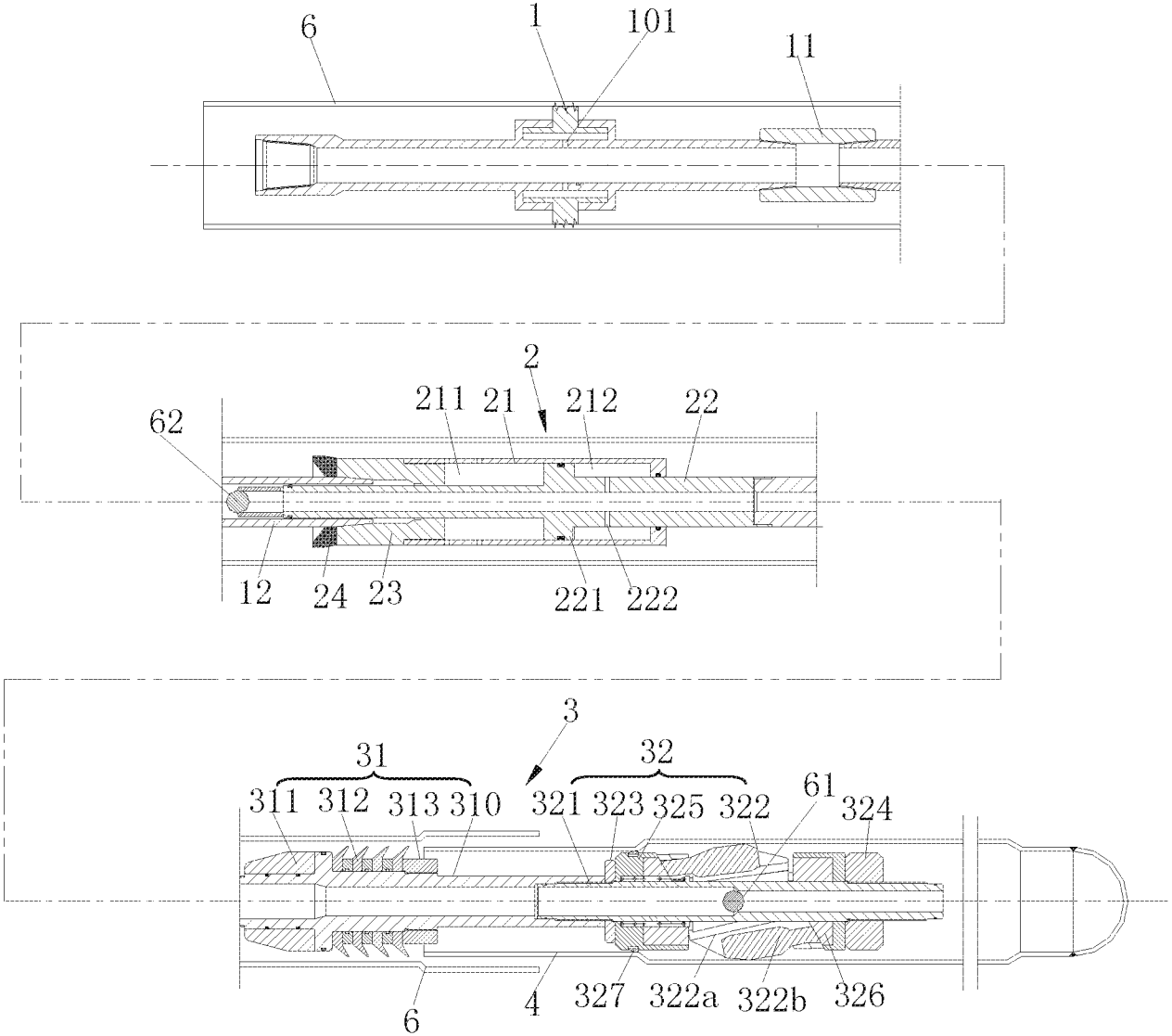
FIG. 3 is a schematic diagram illustrating the present invention when operating in downhole.
Figure 4:
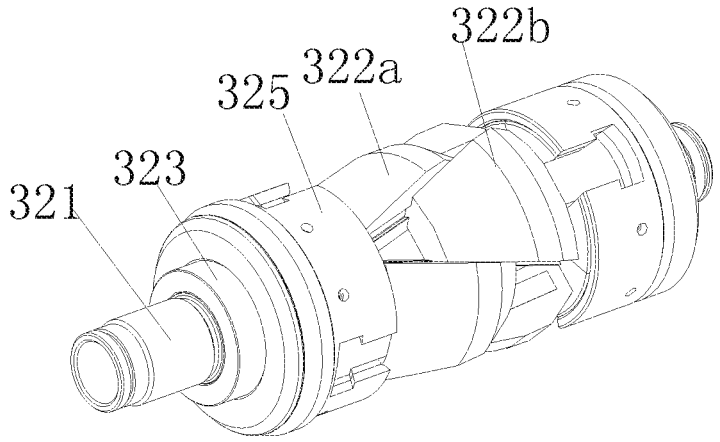
FIG. 4 is a perspective view illustrating a variable-diameter expansion cone portion of the present invention.
Figure 5:
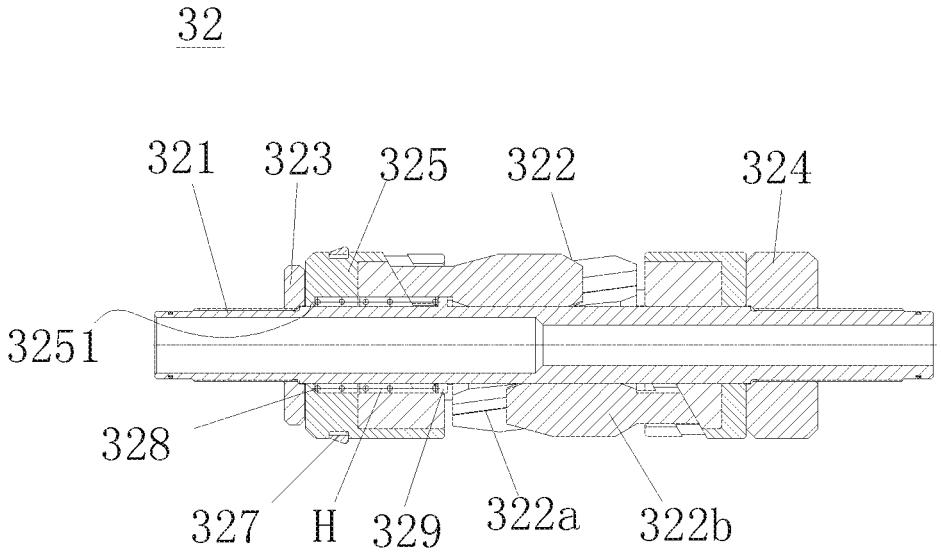
FIG. 5 is a cross-sectional view illustrating a variable-diameter expansion cone portion of the present invention.
Figure 6:
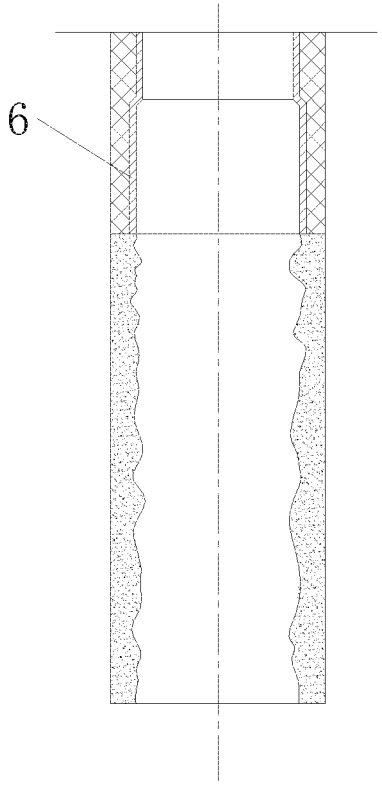
FIG. 6 is a schematic diagram illustrating a front of the expandable tubular disposed in downhole.
Figure 7:
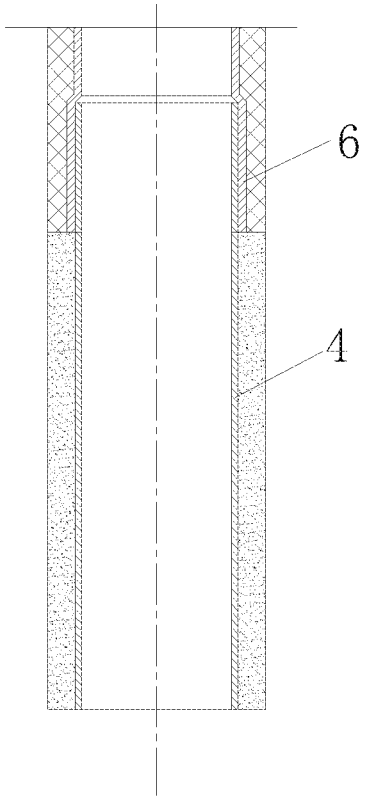
FIG. 7 is a schematic diagram illustrating a rear of the expandable tubular disposed in downhole.

FIG. 1 is a schematic diagram illustrating compositions of a mechanical and hydraulic dual-effect expansion device for well drilling with expandable tubular technology according to the present invention. FIG. 2 is a partial schematic diagram illustrating the present invention when operating in downhole, at a state in which a liquid is initially injected and pressurized. FIG. 3 is a schematic diagram illustrating the present invention when operating in downhole. FIG. 4 is a perspective view illustrating a variable-diameter expansion cone portion of the present invention. [0023] FIG. 5 is a cross-sectional view illustrating a variable-diameter expansion cone portion of the present invention. FIG. 6 is a schematic diagram illustrating a front of the expandable tubular disposed in downhole. FIG. 7 is a schematic diagram illustrating a rear of the expandable tubular disposed in downhole.

As shown in FIG. 1, the present invention provides a mechanical and hydraulic dual-effect expansion device for well drilling with expandable tubular technology, comprising: an anchor 1, a hydraulic cylinder assembly 2, and a variable-diameter expansion cone assembly 3. A lower end of the anchor 1 is connected to an upper end of an insertion connection tube 12 via a coupling 11, and the anchor 1 is located at an uppermost end of a tool string formed in the present invention and can be anchored in downhole when a liquid is injected and pressurized. Specifically, when the anchor 1 is in use, a liquid enters through a liquid incoming hole 101 on its central tube to splint the anchor 1 open by the action of the hydraulic pressure, so as to realize the anchoring function. It should be noted that the anchor 1 falls within the prior art, a detailed description of compositions, structures as well as operating principles thereof is omitted herein.

The hydraulic cylinder assembly 2 comprises a hydraulic cylinder 21, and a piston tube 22 movably disposed within an inner cavity of the hydraulic cylinder 21. The hydraulic cylinder 21 has an upper end connected to the insertion connection tube 12 via a cylinder adjustment cover 23, and a lower end tightly fitted with the piston tube 22. The piston tube 22 passes through an inner cavity of the cylinder adjustment cover 23, and has an upper end inserted in the insertion connection tube 12 and tightly fitted with an inner surface of the insertion connection tube 12. The piston tube 22 is provided on an outer side wall with a protrusion ring 221 coming in contact with an inner surface of the hydraulic cylinder 21, the protrusion ring 221 separating the inner cavity of the hydraulic cylinder 21 into an upper chamber 211 and a lower chamber 212. The piston tube 22 is further provided on side wall with a liquid injection hole 222 in communication with the lower chamber 212. The variable-diameter cone assembly 3 comprises a sealing cone portion 31 capable of expanding the expandable tubular when moving upwards and a variable-diameter expansion cone portion 32 capable of expanding a diameter when the liquid is injected and pressurized. The variable-diameter expansion cone portion 32 can realize an increase or decrease in diameter, is in a status of a small diameter when a tool is running into a wellbore, and can start to expand so as to become a maximum diameter by pressuring after reaching the bottom of the well. An upper end of the sealing cone portion 31 is connected to a lower end of the piston tube 22 and a lower end of the sealing cone portion 31 is connected to an upper end of the variable-diameter expansion cone portion 32. Therefore, in an early stage when the expandable tubular expands, a high-pressure liquid can directly promote expansion of the sealing cone portion 31 and the variable-diameter expansion cone portion 32, and when the sealing cone portion 31 leaves the expandable tubular, it becomes mechanically expanded, i.e., the variable-diameter expansion cone portion 32 completes the remaining portion of the expansion operations under the action of the hydraulic cylinder assembly 2.

A lower end of the insertion connection tube 12 is connected with an upper end of the cylinder adjustment cover 23 through an external thread, a lower end of the cylinder adjustment cover 23 is threadably connected with an upper end of the hydraulic cylinder 21 through an internal thread, and an inner surface of a lower end of the hydraulic cylinder 21 is tightly fitted with the piston tube 22.

Preferably, in order to improve a sealing performance at the upper end of the hydraulic cylinder 21, the upper end of the cylinder adjusting sleeve 23 is provided with a cylinder dustproof ring 24 sleeved onto the insertion connection tube 12. In addition, an outer surface at the upper end of the piston tube 22 is embedded with a piston dustproof ring 25, an inner surface at the lower end of the cylinder adjustment cover 23 is provided with a seal ring groove 233*a*, inside which a seal ring 233*b* is embedded so as to tightly fit with the outer surface of the piston tube 22.

Referring to FIGS. 4 and 5, the variable-diameter expansion cone portion 32 comprises a central tube 321 and a variable-diameter expansion cone 322 capable of expanding a diameter when a liquid is injected and pressurized. An upper end of the central tube 321 is connected to a lower end of the sealing cone portion 31, and the variable-diameter expansion cone 322 is sleeved on the central tube 321 and is provided at both ends thereof with an upper end stop nut 323 and a lower end stop nut 324, respectively. The upper end stop nut 323 and the lower stop nut 324 are threadably connected with the central tube 321.

Preferably, the variable-diameter expansion cone 322 comprises an upper expansion base 325, a plurality of upper expansion cone flaps 322*a*, a plurality of lower expansion cone flaps 322*b*, and a lower expansion base 326. The upper expansion base 325 and the lower expansion base 326 are sleeved onto the central tube 321, and a clamp spring 327 is embedded outside the upper expansion base 325. Each of the upper expansion cone flaps 322*a* and each of the lower expansion cone flaps 322*b* are arranged alternately in the circumferential direction so as to slide in relation to each other, thereby combining as an expansion cone. An upper end of the upper expansion cone flaps 322*a* is movably connected with the upper expansion base 325, and a lower end of the lower expansion cone 322*b* is movably connected to the lower expansion base 326. In use, the variable-diameter expansion cone portion 32 is placed at the lowermost end of the expandable tubular 4, and both the upper expansion cone flaps 322*a* and the plurality of lower expansion cone flaps 322*b* can vary a diameter outward (expanding a diameter) when sliding relative to each other. After the diameter is varied, the maximum outer diameter is equal to the maximum expandable inner diameter of the expanded casing. Both the upper expansion cone flaps 322*a* and the plurality of lower expansion cone flaps 322*b* are typically made of alloy steel with a higher surface hardness. It should be noted that the above upper expansion cone flaps 322*a* and the plurality of lower expansion cone flaps 322*b* are preferably three in number in the illustrated structure, respectively, and the specific structures and operating principles of the two fall within the prior art and a detailed description thereof is omitted here.

As shown in the Figures, an upper end of the upper expansion base 325 is abutted against the upper end stop nut 323, a cavity H is formed between the upper expansion base 325 and the central tube 321, and an inner surface at the upper end of the upper expansion base 325 is provided with a ring retainer 3251 coming in contact with the central tube 321. A return spring 328 and a stopper 329 are provided within the cavity H. An upper end of the return spring 328 comes in contact with the ring retainer 3251 and the lower end thereof comes in contact with the stopper 329. The stopper 329 can be fixed with respect to the central tube 321 by way of connection in pin, bolt or the like.

The sealing cone portion 31 comprises a sealing tube 310, a sealing cone 311, a leather cup 312 opening downwards, and a fixed retaining ring 313, the sealing cone 311, the leather cup 312, and the fixed retaining ring 313 being sequentially sleeved onto the sealing tube 310. The fixed retaining ring 313 is threadably connected with the sealing tube 310, wherein the outer surface of the sealing tube 310 is provided with a ledge 310*a* for positioning the sealing cone 311 and the leather cup 312, and the ledge 310*a* is positioned between the sealing cone 311 and the leather cup 312.

As shown in FIG. 1, a sliding sleeve 13 is placed in the anchor 1 for blocking a liquid incoming hole 101 corresponding to the anchor 1, and is connected with the anchor 1 via a shear pin 14. When moving downwards, the sliding sleeve 13 is capable of entering the insertion connection tube 12 and is supported at the upper end of the piston tube 22, the sliding sleeve 13 having an outer diameter smaller than inner diameters of the coupling 11 and the insertion connection tube 12, and provided at the side wall thereof with a flowbore (not shown).

In operation, the anchor 1, the hydraulic cylinder assembly 2 as well as the variable-diameter expansion cone assembly 3 are placed in an expandable tubular 4, and the sealing cone portion 31 comes in sealing contact with an inner side wall of the expandable tubular 4. A lower end of the expandable tubular 4 is connected (e.g., welding) with a profiled pipe 5 capable of expanding a diameter when the liquid is injected and pressurized, and a free end of the profiled pipe 5 is connected with a lower plug 50.

As shown in FIG. 1, a pipe diameter of front and rear sections 51, 53 of the profiled pipe 5 is larger than that of a middle section 52 of the special tube 5, and a smooth transition connection exists between the front and middle sections 51, 52 and between the middle and rear sections 52, 53. In actual use, it is preferred that the profiled pipe 5 may be an iron tube similar to bellows and may increase a diameter under the effect of hydraulic pressure to become a circular tubular having a larger drift diameter.

Referring to FIGS. 1 to 3, the mechanical and hydraulic dual-effect expansion device for well drilling with expandable tubular technology according to the present invention concretely functions as follows:

during construction, tripping the mechanical and hydraulic dual-effect expansion device for well drilling with expandable tubular technology according to the present invention downwards in a predetermined well section by means of an anchor 1 for connecting a drill stem so that an upper end of the expandable tubular 4 is located in a suitable position in a downhole upper casing 6 and after an upper end of the drill stem is connected to a high-pressure pump and a high-pressure pipeline on the ground, a liquid can be injected and pressurized for implementation of expansion operations;

upon pressurization, the high-pressure liquid enters an inner cavity of the profiled pipe 5 through the anchor 1, the coupling 11, the insertion connection tube 12, the piston tube 22, the sealing tube 310, as well as the central tube 321, wherein since the presence of the sealing cone 311, the leather cup 312 and the fixed retaining ring 313 of the sealing cone portion 31, a sealing contact with the inner side wall of the expandable tubular 4 allows the expandable tubular 4 to form a sealed space at a portion below the sealing cone portion 31 and allows the liquid not to go upwards in the expandable tubular 4, whereby the middle section 52 of the profiled pipe 5 expands by the action of the high-pressure liquid, subsequently, tripping the tool string formed according to the present invention, so that the variable-diameter expansion cone 322 moves down to the expanded profiled pipe 5 (see FIG. 2 for detailed status); continuing to inject and pressurize the liquid, the sealing cone portion 31 implements a primary expansion for the expandable tubular under the action of the liquid and drives movement of the entire tool string upwards, thus the variable-diameter expansion cone 322 also moves upwards along with the tool string; when the clamp spring 327 is stuck on a wall of the expandable tubular 4 after coming in contact with the expandable tubular 4 for which the diameter is not varied, the upper expansion cone flaps 322*a* are positioned in accompany with the upper expansion base 325, subsequently, the fluid pressure is increased, the lower expansion cone flaps 322*b* of the variable-diameter expansion cone 322 move upwards, and the upper and lower expansion cone flaps 322 are slideable in relation to each other and overlapped, so that the expansion cone produced by combining the two achieves a variable diameter in traction of the sealing cone portion 31, after the variable-diameter expansion cone 322 is varied to the maximum diameter, due to the persistent presence of hydraulic pressure, a failure starts at the clamp spring 327, the variable-diameter expansion cone portion 32 starts to move upwards in their entirety along with the sealing cone portion 31, i.e., starting to expand the expandable tubular 4, while the return spring 328 is in a compressed state. Thus, on the one hand, the sealing cone 311 first moves upwards and implements a primary expansion for the expandable tubular; on the other hand, the variable-diameter expansion cone 322 also moves upwards along with the tool string and implements a secondary expansion for the expandable tubular 4 by the action of the high-pressure liquid, whereby the expandable tubular 4 can be expanded to a designed size;

continuously injecting the high-pressure liquid, the variable-diameter cone assembly 3 allows the expandable tubular 4 to continuously move upwards for expansion operations and drives movement of the entire tool string upwards within the expandable tubular, wherein when the sealing cone 311, the leather cup 312 of the sealing cone portion 31 are removed upwards from the upper port of the expandable tubular 4, its sealing state is released with the expandable tubular 4, so that the high-pressure liquid can flow out from the upper port of the expandable tubular 4, and in this case, the expansion operation cannot be continued by injecting and pressuring the liquid (also see FIG. 3);

next, dropping a ball from the wellhead towards the tool string, first dropping a smaller ball 61, so as to be set over the central tube 321, and then dropping a larger ball 62 to fall on the sliding sleeve 13 of the anchor 1, the shear pins 14 on the sliding sleeve 13 are cut off under the hydraulic action, the entire sliding sleeve 13 slides down to the piston tube 22, the liquid incoming hole 101 on the anchor 1 is exposed, and the high-pressure liquid enters the liquid incoming hole 101 and triggers the anchor 1, after the anchor 1 is opened, it is fastened to the inner wall of the upper casing, such that the anchor 1 and the hydraulic cylinder 21 of the hydraulic cylinder assembly 2 are fixed. Since the liquid incoming hole is provided on the side wall of the sliding sleeve 13, the liquid may further enter the piston tube 22 through the space between the sliding sleeve 13 and the coupling 11 and the liquid incoming hole, and hence enter the lower chamber 212 of the hydraulic cylinder 21 from the liquid injection hole 222; driving the movement of the piston tube 22 upwards by pushing the protrusion ring 221 by the action of hydraulic forces, the piston tube 22 drives the variable-diameter expansion cone 322 to continuously move upwards through the sealing tube 310 and the central tube 321, and continues to implement expansion operations for the expandable tubular 4, so that after the upper port of the expandable tubular 4 expands, it is tightly fitted with the inner wall of the upper casting 6, see FIGS. 6 and 7 for the states before and after the concrete operations.

When the expandable tubular 4 is completely expanded, injecting and pressuring the liquid is stopped, the anchor 1 is returned to the closed state, and the tool string of the present invention is pushed to move down by the drill stem. The variable-diameter expansion cone 322 may also move downwards by the action of spring force of the return spring 328 and return to the initial state quickly, and subsequently, the tool string of the present invention is lifted out of the wellhead with the expanded expandable tubular 4 tightly fitted with the well wall only. Thus, the construction operations are completed, that is, subsequent construction operations can be performed.

The embodiments given above are only intended as illustrative ones of the invention and may not serve as a limitation to the present invention. It will be apparent to those skilled in the art that equivalent variations and modifications of the present invention can be made without departing from the scope and spirit of the invention.

The invention claimed is:

1. A mechanical and hydraulic dual-effect expansion device that can be disposed in an expandable tubular, characterized in that the device comprises:

an anchor that can be anchored in downhole when a liquid is injected and pressurized, the anchor having a lower end connected to an upper end of an insertion connection tube via a coupling;

a hydraulic cylinder assembly comprising a hydraulic cylinder, and a piston tube movably disposed within an inner cavity of the hydraulic cylinder, wherein the hydraulic cylinder has an upper end connected to the insertion connection tube via a cylinder adjustment cover and a lower end fitted with the piston tube, the lower end of the hydraulic cylinder can form a sealed connection with the piston tube, wherein the piston tube passes through an inner cavity of the cylinder adjustment cover, and has an upper end inserted in the insertion connection tube and fitted with an inner surface of the insertion connection tube, the upper end of the piston tube can form a sealed connection with the inner surface of the insertion connection tube, wherein the piston tube is provided on an outer side wall thereof with a protrusion ring which comes in contact with an inner surface of the hydraulic cylinder and separates the inner cavity of the hydraulic cylinder into an upper chamber and a lower chamber, and wherein the piston tube is also provided on a side wall thereof with a liquid injection hole in communication with the lower chamber; and a variable-diameter expansion cone assembly comprising a sealing cone portion capable of expanding the expandable tubular when moving upwards and a variable-diameter expansion cone portion having a diameter, the diameter capable of expanding when the liquid is injected and pressurized, wherein the sealing cone portion has an upper end connected to a lower end of the piston tube and a lower end connected to an upper end of the variable-diameter expansion cone portion;

wherein a sliding sleeve is placed in the anchor for blocking a liquid incoming hole in the anchor, and is connected with the anchor via a shear pin; when moving downwards, the sliding sleeve is capable of entering the insertion connection tube and is supported at the upper end of the piston tube, the sliding sleeve having an outer diameter smaller than an inner diameter of the coupling and the insertion connection tube, and the side wall of the sliding sleeve being provided with a flowbore.

2. The mechanical and hydraulic dual-effect expansion device according to claim 1, wherein a lower end of the insertion connection tube is connected with an upper end of the cylinder adjustment cover through an external thread, a lower end of the cylinder adjustment cover is threadably connected with an upper end of the hydraulic cylinder through an internal thread, and an inner surface of the lower end of the cylinder adjustment cover is fitted with the piston tube, the inner surface of the lower end of the cylinder adjustment cover can form a sealed connection with the piston tube.

3. The mechanical and hydraulic dual-effect expansion device according to claim 1, wherein the variable-diameter expansion cone portion comprises: a central tube and a variable-diameter expansion cone having the diameter, the diameter capable of expanding when the liquid is injected and pressurized, an upper end of the central tube is connected to the lower end of the sealing cone portion, the variable-diameter expansion cone is sleeved on the central tube and is provided at both ends thereof with an upper end stop nut and a lower end stop nut, respectively, and the upper end stop nut and the lower stop nut are threadably connected with the central tube.

4. The mechanical and hydraulic dual-effect expansion device according to claim 3, wherein the variable-diameter expansion cone comprises an upper expansion base, a plurality of upper expansion cone flaps, a plurality of lower expansion cone flaps, and a lower expansion base, the upper expansion base and the lower expansion base are sleeved onto the central tube, a clamp spring is embedded outside the upper expansion base, each of the upper expansion cone flaps and each of the lower expansion cone flaps are arranged alternately in the circumferential direction so as to slide in relation to each other, thereby combining as an expansion cone, an upper end of the upper expansion cone flaps is movably connected with the upper expansion base, and a lower end of the lower expansion cone flaps is movably connected with the lower expansion base.

5. The mechanical and hydraulic dual-effect expansion device according to claim 4, wherein an upper end of the upper expansion base is abutted against the upper end stop nut, a cavity is formed between the upper expansion base and the central tube, an inner surface at the upper end of the upper expansion base is provided with a ring retainer coming in contact with the central tube, the cavity is provided with a return spring and a stopper, an upper end of the return spring comes in contact with the ring retainer and the lower end thereof comes in contact with the stopper, and the stopper is fixed with respect to the central tube.

6. The mechanical and hydraulic dual-effect expansion device according to claim 5, wherein the sealing cone portion comprises a sealing tube, a sealing cone, a leather cup opening downwards, and a fixed retaining ring, the sealing cone, the leather cup and the fixed retaining ring are sequentially sleeved onto the sealing tube, the fixed retaining ring is threadably connected with the sealing tube, a lower end of the sealing tube is connected to an upper end of the variable-diameter expansion cone portion, the outer surface of the sealing tube is provided with a ledge, the sealing cone is adjacent to an upper side of the ledge, and the cup is adjacent to a lower side of the ledge.

7. The mechanical and hydraulic dual-effect expansion device according to claim 1, further comprising the expandable tubular wherein the lower end of the expandable tubular is connected with a profiled pipe having the diameter, the diameter capable of expanding when the liquid is injected and pressurized, and a free end of the profiled pipe is connected with a lower plug.

8. The mechanical and hydraulic dual-effect expansion device according to claim 7, wherein the profiled pipe has front, middle, and rear sections, a pipe diameter of the front and rear sections being larger than that of the middle section, and a smooth transition connection existing between the front and middle sections and between the middle and rear sections.

9. The mechanical and hydraulic dual-effect expansion device according to claim 1, wherein the variable-diameter expansion cone portion comprises: a central tube and a variable-diameter expansion cone having the diameter, the diameter capable of expanding when the liquid is injected and pressurized, an upper end of the central tube is connected to the lower end of the sealing cone portion, the variable-diameter expansion cone is sleeved on the central tube and is provided at both ends thereof with an upper end stop nut and a lower end stop nut, respectively, and the upper end stop nut and the lower stop nut are threadably connected with the central tube.

10. The mechanical and hydraulic dual-effect expansion device according to claim 1, wherein the sealing cone portion comprises a sealing tube, a sealing cone, a leather cup opening downwards, and a fixed retaining ring, the sealing cone, the leather cup and the fixed retaining ring are sequentially sleeved onto the sealing tube, the fixed retaining ring is threadably connected with the sealing tube, a lower end of the sealing tube is connected to an upper end of the variable-diameter expansion cone portion, the outer surface of the sealing tube is provided with a ledge, the sealing cone is adjacent to an upper side of the ledge, and the cup is adjacent to a lower side of the ledge.

* * * * *